United States Patent [19]

Clegg

[11] 3,944,903

[45] Mar. 16, 1976

[54] POSITION TRANSDUCER ARRANGEMENT

[75] Inventor: Roy Clegg, Sheffield, England

[73] Assignee: Davy-Loewy Limited, Sheffield, England

[22] Filed: Jan. 16, 1974

[21] Appl. No.: 433,658

[30] Foreign Application Priority Data

Jan. 16, 1973 United Kingdom ..... 2176/73

[52] U.S. Cl. ..... 318/606; 318/562; 318/662

[51] Int. Cl.[2] ..... G05B 1/01

[58] Field of Search ..... 316/607, 606, 662, 562

[56] References Cited

UNITED STATES PATENTS

| | | | |
|---|---|---|---|
| 2,429,771 | 10/1947 | Roberts | 318/607 |
| 3,005,135 | 10/1961 | Palmer et al. | 318/607 |
| 3,503,058 | 3/1970 | Ault et al. | 318/607 X |
| 3,760,251 | 9/1973 | Posi et al. | 318/562 X |

*Primary Examiner*—Benjamin Dobeck

*Attorney, Agent, or Firm*—Brisebois & Kruger

[57] ABSTRACT

In a position transducer arrangement one or more AC operable position transducers are energised by the output of a variable amplitude oscillator. The output signals from the oscillator and the or each transducer are demodulated, or detected in turn by the same demodulator and the demodulated oscillator signal is compared with a reference signal to produce a difference signal. The difference signal is used to adjust the amplitude of the oscillator signal in the sense to reduce the difference signal to zero.

11 Claims, 2 Drawing Figures

POSITION TRANSDUCER ARRANGEMENT

Figure 1:
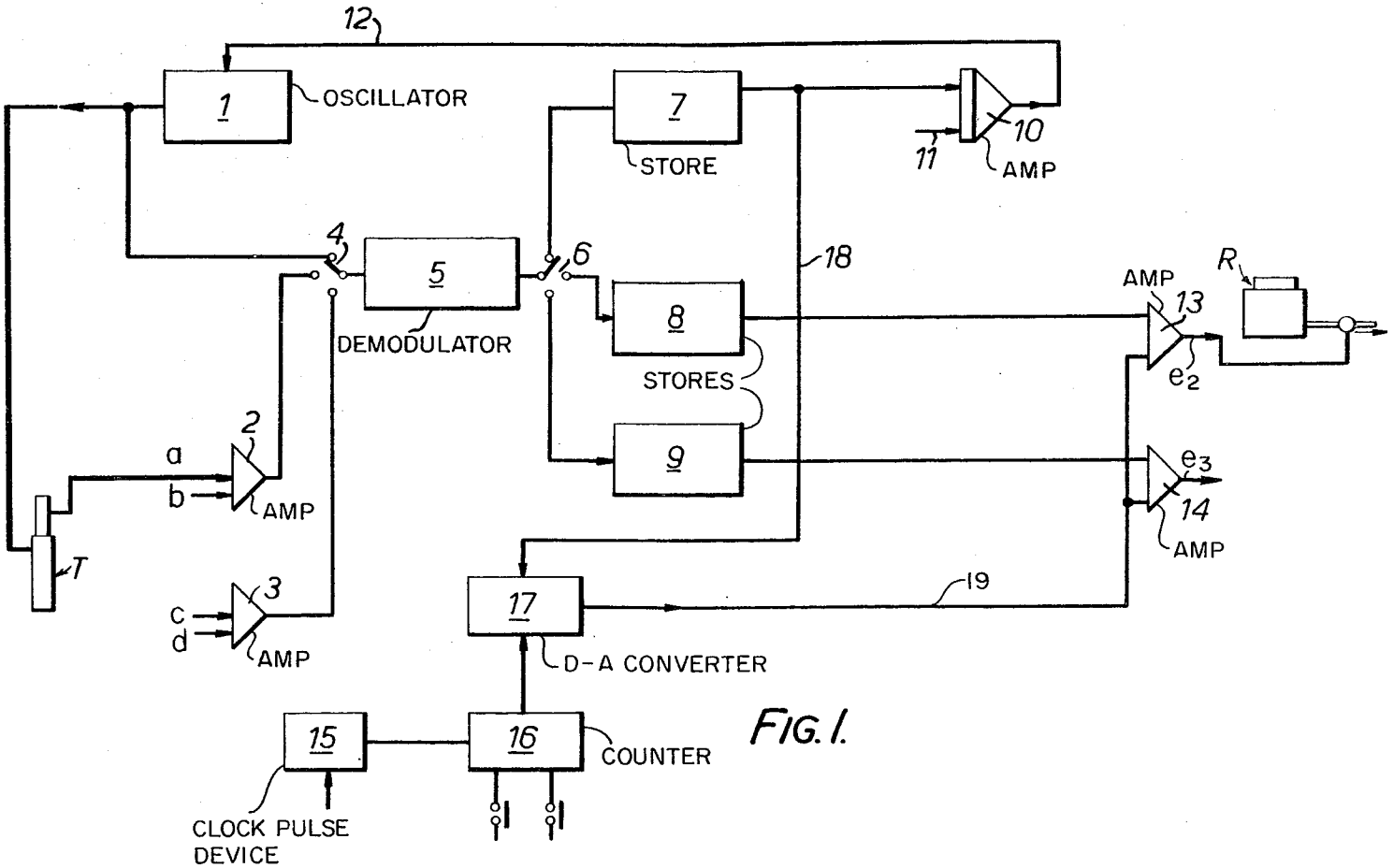

This invention relates to an arrangement including one or more AC position transducers.

A particular, but not sole, application of the invention resides in a position transducer arrangement which forms part of a closed loop position control system. The control system may be used for controlling the gap between a pair of work rolls of a rolling mill. Position transducers having a pair of relatively movable members are known as are AC position transducers in which the transducer is energised with an alternating voltage and an alternating voltage output is obtained which is representative of the position of one of the members with respect to the other. AC position transducers are energised by an oscillator and consequently the output signal from the transducer is proportional to the relative positions of the two members and also to the oscillator amplitude. The output signal may then be demodulated or detected to give a measure of the relative position of the two members. The demodulated or detected output signal is dependent on both the amplitude of the oscillations from the oscillator and the gain of the demodulator detector and as both of these quantities may vary the output signal from the transducer may be subject to errors.

It is an object of the present invention to provide a position transducer arrangement employing AC position transducers in which the above-mentioned difficulties are largely overcome.

According to the present invention in a position transducer arrangement one or more AC position transducers are energised by the output signal of a variable amplitude oscillator and the output signals of the oscillator and the or each transducer are demodulated in turn by the same demodulator and the demodulated oscillator signal is compared with a reference voltage to produce a difference signal and said difference signal is employed to adjust the amplitude of the oscillator in the sense to reduce said difference signal substantially to zero.

By comparing the demodulated output signal from the oscillator with a reference signal and adjusting the amplitude of the oscillator output if necessary, a high accuracy output from the transducers is obtained because the demodulated output of the or each transducer does not change if the amplitude of the oscillator signal varies and/or the gain of the demodulator changes.

According to a second aspect of the invention a position transducer circuit comprises at least one AC position transducer having an input and output, a variable amplitude oscillator connected to the input of the or each transducer, the output of the oscillator and the output of the or each transducer being connected to respective switch inputs of a demodulator, the output of the demodulator being connected through separate output switches to respective stores, means for switching said demodulator input and output switches in sequence to connect said oscillator and the or each transducer in turn through the demodulator to said respective stores, means for comparing the signal in said oscillator signal store with a reference signal to produce a difference signal and means in the oscillator responsive to said difference signal to adjust the output amplitude of the oscillator in the sense to reduce said difference signal substantially to zero.

Such a position transducer circuit in which the position transducer indicates the position of a first member movable with respect to a second member may be in combination with a position control system capable of moving said first member with respect to the second member, said position control system including means for receiving and comparing a signal representative of the desired position of the first member and the demodulated signal of the position transducer to produce an error signal which is employed to move the first member in the sense to reduce said error signal substantially to zero.

Figure 2:
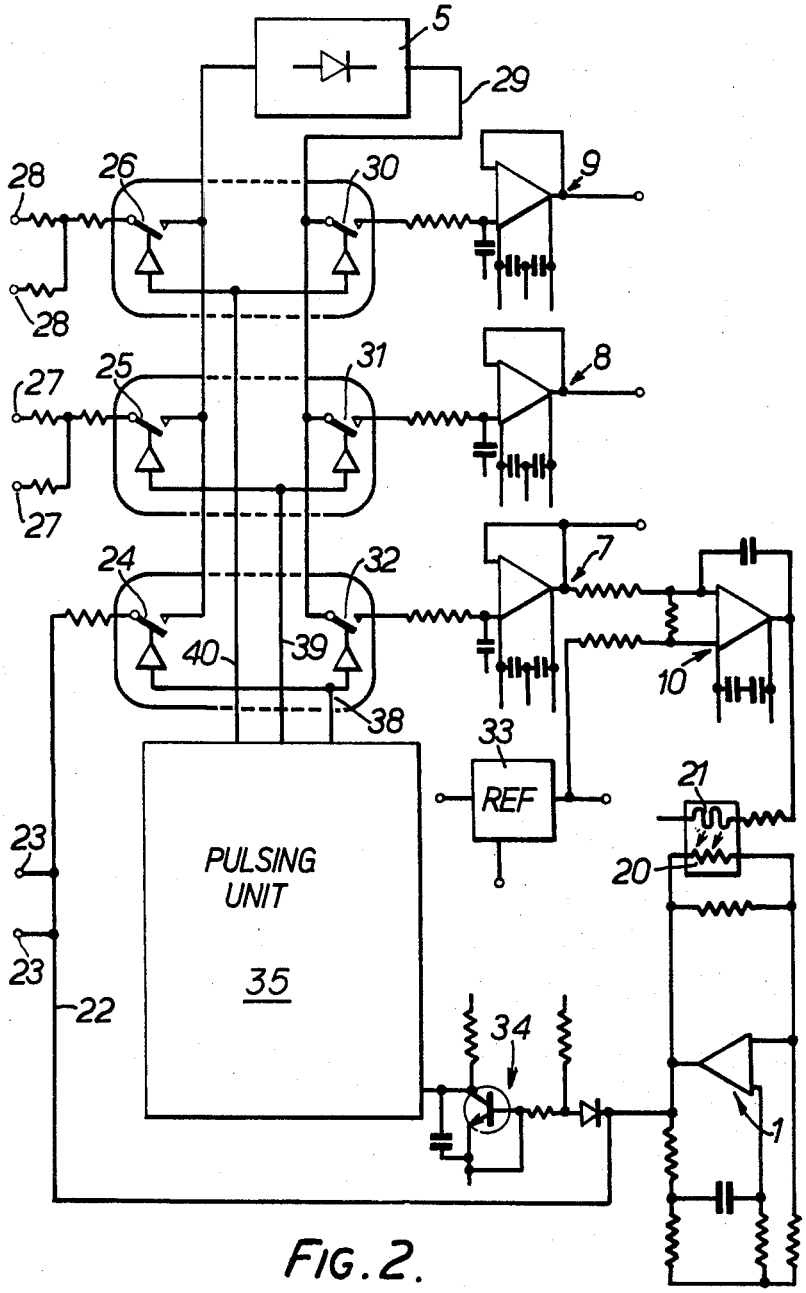

In order that the invention may be more readily understood it will now be described, by way of example only, with reference to the accompanying drawings in which:

FIG. 1 is a schematic diagram showing a position transducer arrangement suitable for use in a rolling mill, and FIG. 2 is a circuit diagram of part of the arrangement shown in FIG. 1.

A rolling mill has a pair of AC position transducers, such as variable capacity transducers, associated with the bearing chocks at one end of a roll of the mill and a further pair of similar AC transducers associated with the bearing chocks at the other end of the same roll. The purpose of the transducers is to indicate the position of the roll chocks relative to the mill housing. Displacement means such as hydraulic rams are associated with these chocks to adjust the position of the chocks and hence the roll relative to the mill housings.

Referring now to FIG. 1 one of the AC position transducers is indicated by reference T and one of the hydraulic rams is indicated by reference R.

The four transducers associated with the bearing chocks are energised by the output of a variable amplitude oscillator 1. The output signals from the pair of transducers associated with one bearing chock are applied to terminals a and b, respectively of summing amplifier 2 and the outputs from the other pair of transducers are applied to terminals c and d, respectively of summing amplifier 3. The output of the oscillator 1 and the outputs of the summing amplifiers 2 and 3 are applied to a selector scanning switch 4 which feeds the outputs in turn to a single demodulator or detector 5. The output of the demodulator is applied by way of a selector scanning switch 6, which is synchronised with the switch 4, to one or other of three electronic store banks 7, 8 and 9. The output of store 7 which is the demodulated oscillator signal is applied to a comparison amplifier 10 which also receives a reference signal on an input 11. In the comparison amplifier the two signals are compared to produce a difference signal which is fed on a line 12 to the oscillator 1 to adjust its amplitude in the sense to reduce the difference signal to zero. This arrangement ensures that if the gain of the demodulator changes during use, the demodulated output signals from the stores 8 and 9 do not change.

The output signals from the stores 8 and 9 are supplied one to each of a pair of amplifiers 13, 14 which also receive signals on line 19 from a reference circuit. The amplifiers produce error signals on lines $e_2$ and $e_3$ which are difference signals between the signal on 19 and the two imput signals from store 8 and 9, respectively. The error signals control servo valves which in turn control the displacement of the hydraulic rams R associated with the chocks of the rolling mill roll.

The reference circuit comprises a clock pulse device 15 which supplies pulses to a counter 16 which either counts up the pulses or counts down the pulses and the output is supplied to a digital - analog converter 17 which also receives the demodulated oscillator signal from the store 7 on a line 18. The analog output is supplied as the reference to the amplifiers 13 and 14. This results in achieving further accuracy because the accuracy of the control system is independent of the actual amplitude of the oscillator.

Referring now to FIG. 2, the oscillator 1 is of transistorised form and the feed back loop includes a heat sensitive resistor 20 which is thermally coupled with a heating element 21. The output of the oscillator is supplied on a line 22 to terminals 23 to which the AC transducers are connected and to a switch 24. The switch 24 is normally open but when it is closed the signal on the line 22 is passed to the demodulator 5. Connected in parallel with the switch 24 are two further switches 25 and 26 and the outputs of the pair of transducers associated with the bearing chocks at one end of the mill rolls are supplied to terminals 27 which are connected to the switch 25 and similarly the outputs of the pair of AC transducers associated with the bearing chock assembly at the opposite end of the roll are supplied to terminals 28 which are connected to the switch 26. As shown at FIG. 2, demodulator 5 is a detector, and includes a diode for detecting or rectifying the oscillating input signal so the output signal of the demodulator is indicative of the amplitude of the oscillating input signal.

The output of the demodulator is connected by a line 29 to three further normally open switches 30, 31, and 32 connected in parallel. The switches 30, 31 and 32 are connected to electronic stores 9, 8 and 7 respectively. The output from store 7 is applied as one input to a comparator 10 and the comparator also receives a signal from a reference device 33. The output from the comparator 10, which is representative of the difference between the two input signals is supplied to the heating element 21 to vary the resistance of the resistor 20 in the feed back circuit of the oscillator 1.

The output from the oscillator 1 is also applied to a shaping circuit 34 which changes the sinusoidal wave form of the oscillations from the oscillator 1 to square wave form. The square wave output from circuit 34 is applied to a counter forming part of a pulsing unit 35. The counter produces an output signal on the receipt of a certain number of pulses say after 4, 8, 12 and 13 pulses. The output on the thirteenth pulse clears the counter and repeats the counting in stages of four pulses. The output signals from one bank of the counter is passed through an invertor circuit into a logic circuit which provides output signals each of four pulse duration and in sequence on the lines 38, 39 and 40. The line 38 is connected to means for operating the pair of switches 24 and 32 in synchronism, the line 39 is connected to means for operating the switches 25 and 31 in synchronism and similarly the line 40 is connected to means for operating the switches 26 and 30 in synchronism.

During one period of four cycles from the oscillator 1 the oscillator output is applied through switch 24 to the demodulator 5 and the output of the demodulator is supplied through switch 32 to the store 7. At the end of the four pulse cycle the switches 24 and 32 are opened and the switches 25 and 31 are closed also for a four pulse period so that the transducer outputs received at the terminals 27 are supplied to the demodulator and then to the store 8. During the next four pulse period the outputs of the transducers received at terminals 28 are supplied to the demodulator 5 and then to the store 9. The sequence is then repeated by the logic 37 opening and closing the appropriate pairs of switches in sequence.

I claim:

1. A position transducer circuit comprising at least one AC position transducer having an input and an output, a variable amplitude oscillator connected to the input of the transducer, the output of the oscillator and the output of the transducer connected to respective switch inputs of a demodulator, the output of the demodulator connected through separate output switches to respective stores, means for switching said demodulator input and output switches together and in sequence to connect said oscillator and the transducer in turn through the demodulator to said respective stores, means for comparing the signal in said oscillator signal store with a reference signal to produce a difference signal and means in the oscillator responsive to said difference signal to adjust the output of the oscillator in the sense to reduce said difference signal substantially to zero.

2. The combination of a position transducer circuit as claimed in claim 8 in which the position transducer indicates the position of a first member movable with respect to a second member, and which further includes, a position control system capable of moving said first member with respect to the second member, said position control system including means for receiving and comparing a signal representative of the desired position of the first member, and the demodulated signal of the position transducer to produce an error signal which is employed to move the first member in the sense to reduce said error signal substantially to zero.

3. A position transducer arrangement comprising at least one A.C. position transducer having an input and one output, an oscillator having means for adjusting the amplitude of its oscillations, said oscillations being supplied to said input of the transducer, a demodulator having an input and an output, first switching means for switching the output of the oscillator and the output of the transducer repeatedly in turn to the input of the demodulator, first and second electronic stores, second switching means operable in synchronism with the first switching means for switching the demodulated oscillator output and the demodulated transducer output from the demodulator repeatedly in turn to the first and second stores respectively, and comparison circuit means for continuously comparing the contents of the first store and a reference signal to produce an error signal, said error signal being applied to the oscillator adjusting means to adjust the amplitude of the oscillator in the sense to reduce said error signal to zero.

4. A position transducer arrangement according to claim 3 wherein, there are a plurality of A.C. position tranducers each having an input, and an output, said oscillations of the oscillator being supplied to an input of each transducer, said first switching means includes means for switching the output of the oscillator and the output of each transducer repeatedly in turn to the input of the demodulator, and at least one additional electronic store, said second switching means includes means for switching the demodulated oscillator output from the demodulator repeatedly in turn to the first, second, and additional stores respectively.

5. A position transducer arrangement comprising an oscillator having an output and the amplitude of the signals from which can vary;

at least one A.C. position transducer having an output;

means connecting the output of the oscillator to the transducer to energize the transducer;

demodular means for producing an output signal indicative of the amplitude of an oscillating signal at its input, said demodulator means having an output;

means for connecting the output of the oscillator and the transducer repeatedly and in turn to the input of said demodulator means;

a reference voltage;

comparing means for comparing the output of the demodulator means resulting from connection of the oscillator to the demodulator input with the reference voltage to produce a difference signal;

means responsive to said difference signal to adjust the amplitude of the oscillator output in the sense to reduce said difference signal to substantially zero so that the demodulated output signal of the transducer is essentially constant for a particular condition of the transducer.

6. A position transducer arrangement according to claim 5 wherein said means connecting the output of the oscillator and output of the transducer to the input of the demodulator comprises switch means for switching in sequence to connect the output of the oscillator and the transducer repeatedly and in turn to the input of the demodulator, said switch means including respective switches connected in parallel to the input of the demodulator.

7. A position transducer arrangement according to claim 6 further comprising additional switch means for switching the output of the demodulator in sequence, said additional switch means including a plurality of switches arranged in parallel to connect the output of the demodulator through said switches in turn.

8. A position transducer arrangement according to claim 7 wherein said switch means comprises a first plurality of switches at the input of the demodulator; said additional switch means comprises a second plurality of switches at the output of the demodulator and equal in number to the first plurality of switches and arranged in pairs with the first plurality of switches; means for switching in pairs to sequentially switch the demodulator out and the oscillator and transducer outputs.

9. A position transducer arrangement according to claim 8 which further includes, means for switching each pair of switches for a time period equal to the period of a fixed number of cycles of the oscillator.

10. A position transducer arrangement according to claim 7 which further includes a plurality of electronic stores, connected respectively to said plurality of switches of said additional switch means.

11. A position transducer arrangement according to claim 10 wherein one of said electronic stores includes means for storing demodulator output signals indicative of the amplitude of the oscillator signal, and said comparing means compares the demodulator output signal in said store with the reference voltage to produce said difference signal.

* * * * *